US011759688B2

(12) United States Patent
Chen et al.

(10) Patent No.: US 11,759,688 B2
(45) Date of Patent: Sep. 19, 2023

(54) ARTIFICIAL SHUTTLECOCK AND FEATHER AND PREPARATION METHOD THEREOF

(71) Applicant: Victor Rackets Industrial Corp., Taipei (TW)

(72) Inventors: Shu-Jung Chen, Taipei (TW); Tzu-Wei Wang, Taipei (TW); Hsin-Chen Wang, Taipei (TW); Cheng-Yu Chang, Taipei (TW)

(73) Assignee: Victor Rackets Industrial Corp., Taipei (TW)

( * ) Notice: Subject to any disclaimer, the term of this patent is extended or adjusted under 35 U.S.C. 154(b) by 143 days.

(21) Appl. No.: 17/563,260

(22) Filed: Dec. 28, 2021

(65) Prior Publication Data

US 2022/0219057 A1 Jul. 14, 2022

(30) Foreign Application Priority Data

Jan. 13, 2021 (TW) ..... 110101320

(51) Int. Cl.
*A63B 67/187* (2016.01)
*A63B 67/19* (2016.01)
*A63B 102/04* (2015.01)

(52) U.S. Cl.
CPC ..... *A63B 67/19* (2016.01); *A63B 67/187* (2016.01); *A63B 2102/04* (2015.10); *A63B 2225/01* (2013.01)

(58) Field of Classification Search
CPC ..... A63B 67/187; A63B 67/19
See application file for complete search history.

(56) References Cited

U.S. PATENT DOCUMENTS

| | | | | |
|---|---|---|---|---|
| 6,709,353 | B1 * | 3/2004 | Peterson | A63B 67/187 473/580 |
| 8,992,355 | B2 * | 3/2015 | Yoneyama | A63B 67/187 473/580 |
| 9,061,193 | B2 * | 6/2015 | Dai | A63B 67/187 |
| 9,937,399 | B1 * | 4/2018 | Peterson | A63B 67/187 |
| 10,065,096 | B2 * | 9/2018 | Chen | A63B 67/19 |
| 10,576,346 | B2 * | 3/2020 | Sakaguchi | A63B 67/19 |
| 10,814,196 | B2 | 10/2020 | Chen et al. | |
| 10,857,440 | B2 * | 12/2020 | Matsushima | A63B 67/187 |

FOREIGN PATENT DOCUMENTS

| | | |
|---|---|---|
| CN | 201889048 U | 7/2011 |
| CN | 111359183 A | 7/2020 |

* cited by examiner

*Primary Examiner* — John A Ricci

(57) ABSTRACT

An artificial shuttlecock, a feather and a preparation method thereof are provided. The feather includes a connecting portion, a first portion, a second portion and a concave. The first portion and the second portion are disposed on the opposite sides of the connecting portion. The concave is located at an outer edge of the second portion. The concave is formed by the following steps of: defining an overlapped outline, which is the outline of the adjacent feather overlapping on the second portion; defining a reference point, which is a point where the overlapped outline is closest to the connecting portion; defining a shifting reference line, which passes through the reference point and is parallel to the connecting portion; defining a reference outline, which is located outside the shifting reference line; and cutting the reference outline to form the concave.

16 Claims, 8 Drawing Sheets

ARTIFICIAL SHUTTLECOCK AND FEATHER AND PREPARATION METHOD THEREOF

BACKGROUND

1. Technical Field

The present disclosure relates to an artificial shuttlecock, and more particularly, to a feather of an artificial shuttlecock and a preparation method thereof.

2. Description of the Related Art

Badminton is a common and popular ball game, in which players hit a shuttlecock as a way to play the game. The main structure of a traditional shuttlecock comprises natural feathers connected to a ball head. The natural feathers are mostly goose feathers or duck feathers, which are screened and processed to make a shuttlecock. However, it is getting more and more difficult to obtain natural feathers, and the screening procedures are complicated and labor-intensive. Therefore, there are also artificial shuttlecocks on the market, trying to solve the problem of shortage of natural feathers and complicated screening procedures.

However, most artificial shuttlecocks use a soft ball skirt made of nylon instead of natural feathers, and the structure of the soft ball skirt allows the shuttlecock to flow with the airflow generated when the shuttlecock is hit. However, the shuttlecock made of such a soft ball skirt demonstrates a lower flight performance and lesser sense of hitting impact when compared to a shuttlecock made of natural feathers, making it difficult for users to accept.

At present, there are also kite-shaped feather made of plastic with holes or cuts made on the feather to simulate the flight performance and sense of hitting impact of a natural feather-made shuttlecock. The arrangement of feather on the head of this type of artificial shuttlecock is based on the arrangement of a natural shuttlecock. The short axis of the kite shape overlaps with the adjacent feather. However, since the feathers made of plastic are thicker than natural feathers, there is still room for improvement in the flight performance of this type of artificial shuttlecock when it is hit.

SUMMARY

In view of the above-mentioned problems, the main object of the present disclosure is to provide an artificial shuttlecock, a feather and a preparation method thereof, which forms a novel concave in the feather to solve the problem of poor flight performance when the conventional artificial shuttlecock is hit.

In order to achieve the above object, the present disclosure provides a feather fir an artificial shuttlecock The artificial shuttlecock comprises a ball head, a plurality of stems and a plurality of feathers, each one of the plurality of stems has one end inserted into the ball head and another end connected to one of the plurality of feathers respectively, each one of the plurality of feathers comprising: a connecting portion, a first portion, a second portion, a first opening, and a concave. The connecting portion is connected to one of the plurality of stems. The first portion and a second portion are disposed on the opposite sides of the connecting portion respectively. The first opening is disposed in the first portion. The concave is located at an outer edge of the second portion. Furthermore, the concave is formed by the following steps of: defining an overlapped outline, which is the outline of the adjacent feathers overlapping on the second portion; defining a reference point, which is a point where the overlapped outline is closest to the connecting portion; defining a shifting reference line, which passes through the reference point and is parallel to the connecting portion; defining a reference outline in the second portion, wherein the reference outline has the same configuration as that of an outline of the first portion, and the reference outline is located outside the shifting reference line; and cutting the reference outline to form the concave.

In order to achieve the above object, the present disclosure also provides a method for preparing a feather for an artificial shuttlecock. The artificial shuttlecock comprises a ball head, a plurality of stems and a plurality of feathers, each one of the plurality of stems has one end inserted into the ball head and another end connected with one of the plurality of feathers respectively. The method for preparing the feathers comprises the following steps of: obtaining the feather having a kite shape, wherein the feather comprises a connecting portion, a first portion, and a second portion, the connecting portion is connected to one of the plurality of stems, the first portion and the second portion are disposed on the opposite sides of the connecting portion respectively; piercing through the first portion to form a first opening; defining an overlapped outline in the second portion, which is the outline of the adjacent feathers overlapping on the second portion; defining a reference point, which is a point where the overlapped outline is closest to the connecting portion; defining a shifting reference line in the second portion, which passes through the reference point and is parallel to the connecting portion; defining a reference outline in the second portion, wherein the reference outline has the same configuration as that of an outline of the first portion, and the reference outline is located outside the shifting reference line; and cutting the reference outline to form a concave.

In order to achieve the above object, the present disclosure also provides an artificial shuttlecock comprising a ball head, a plurality of stems, and a plurality of feathers. Each one of the plurality of stems having one end inserted into the ball head. Each one of the plurality of feathers is connected to another end of each one of the plurality of stems respectively. Each one of the plurality of feathers comprises a connecting portion, a first portion and a second portion, a first opening, and a concave. The connecting portion is connected to one of the plurality of stems. The first portion and second portion are disposed on the opposite sides of the connecting portion respectively. The first opening is disposed in the first portion, and the concave is located at an outer edge of the second portion. Furthermore, the concave is formed by the following steps of defining an overlapped outline, which is the outline of the adjacent feathers overlapping on the second portion; defining a reference point, which is a point where the overlapped outline is closest to the connecting portion; defining a shifting reference line, which passes through the reference point and is parallel to the connecting portion; defining a reference outline in the second portion, wherein the reference outline has the same configuration as that of an outline of the first portion, and the reference outline is located outside the shifting reference line; and cutting the reference outline to form the concave.

According to an embodiment of the present disclosure, the reference outline is the outline of the first portion being shifted to the second portion, so that the reference outline is parallel to the outline of the first portion.

According to an embodiment of the present disclosure, the reference outline is the outline of the first portion shifted upwards or downwards after being shifted to the second portion.

According to an embodiment of the present disclosure, the reference outline is the outline of the first portion being rotated by a predetermined angle after being shifted to the second portion.

According to an embodiment of the present disclosure, the predetermined angle is between 3 degrees and 10 degrees.

According to an embodiment of the present disclosure, a long axis of the first opening is parallel to the connecting portion, the connecting portion has a first length, the first opening has a second length, and the ratio of the second length to the first length is between 0.22 and 0.31.

According to an embodiment of the present disclosure, the feather further comprises a second opening disposed in the second portion and not in contact with the concave.

According to an embodiment of the present disclosure, the feather is originally in a kite-shaped configuration, and after the second portion is cut to form the concave, the feather turns into an irregular configuration.

As described above, according to the artificial shuttlecock, the feather, and the method for preparing the feather of the present disclosure, the opposite sides of the connecting portion of the feather are formed into a first portion and a second portion respectively. By forming an (first) opening in the first portion and a concave formed in the outer edge of the second portion, the feathers are formed into an irregular shape. Furthermore, the concave is formed by first defining an overlapped outline and then cutting along a reference outline. After performing a hitting impact test on the artificial shuttlecock of the present disclosure, it can be found out that the artificial feather consisted of irregular feathers (with concaves) has better aerodynamic stability than that of the conventional artificial shuttlecock, that is, it has better flight performance.

DETAILED DESCRIPTION OF THE EMBODIMENTS

In order to make the structure and characteristics as well as the effectiveness of the present disclosure to be further understood and recognized, the detailed description of the present disclosure is provided as follows along with embodiments and accompanying figures.

Figure 1:
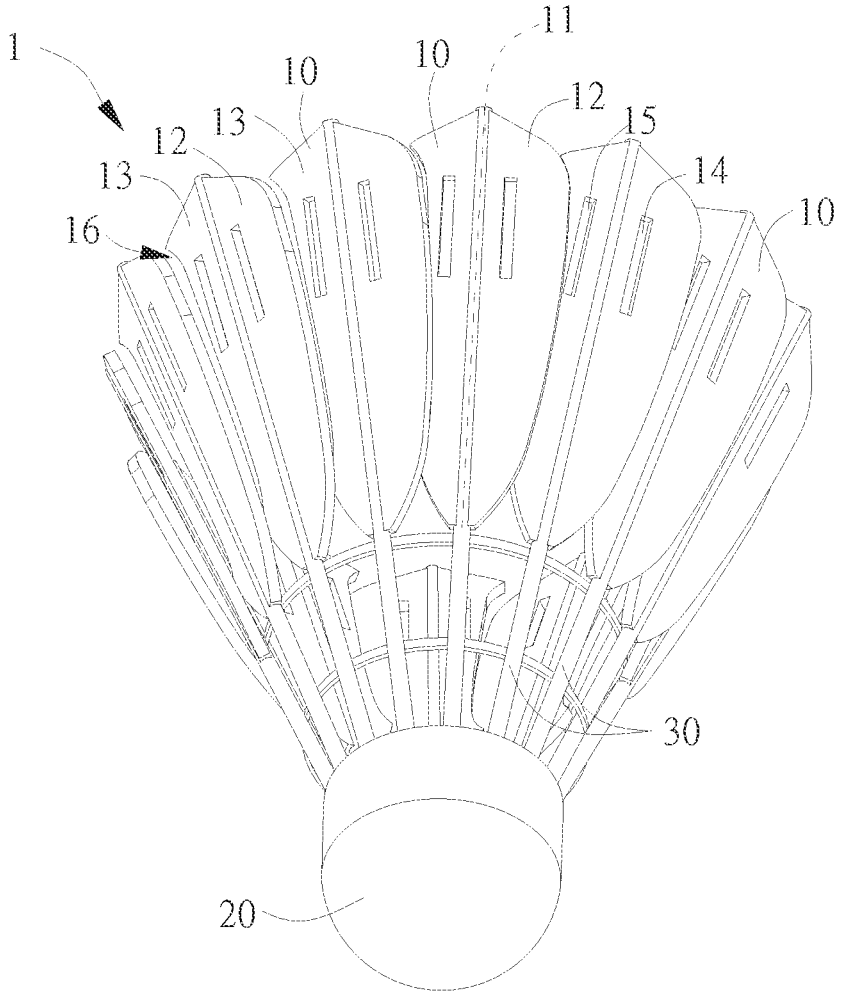
FIG. 1 illustrates a schematic diagram of an artificial shuttlecock according to an embodiment of the present disclosure.
Figure 2:
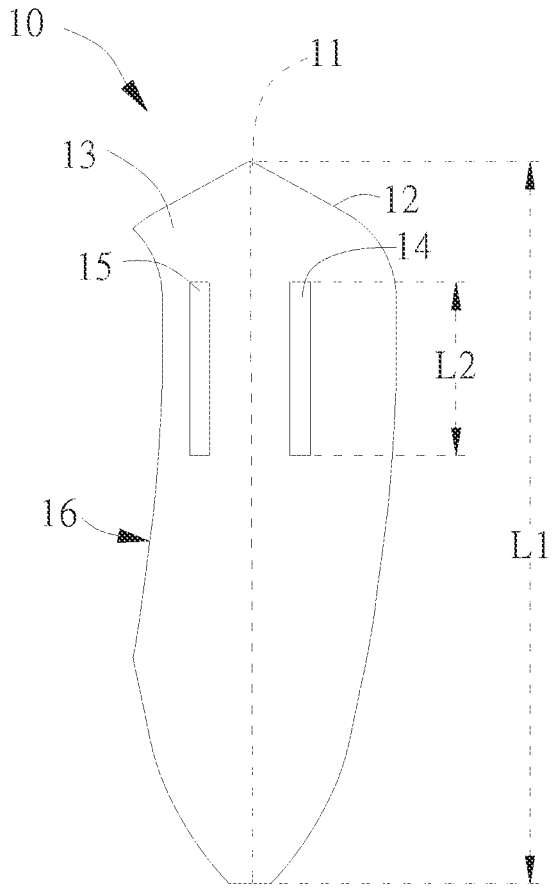
FIG. 2 illustrates a schematic plan view of the feather shown in FIG. 1.

FIG. 1 illustrates a schematic diagram of an artificial shuttlecock according to an embodiment of the present disclosure, and FIG. 2 illustrates a schematic plan view of the feather shown in FIG. 1. Please refer to FIG. 1 and FIG. 2. The artificial shuttlecock 1 includes a plurality of feathers 10, a ball head 20, and a plurality of stems 30. The plurality of stems 30 is arranged on the ball head 20 at intervals, and one end of each stem 30 is inserted into the ball head 20, and the other end is connected with a feather 10. It should be noted that this embodiment uses the special structure of the feather 10 to improve the flight performance of the artificial shuttlecock 1 when it is hit. In this embodiment, each feather 10 is connected to each stem 30, that is, the feather 10 is connected to the stem 30 respectively. In addition, each feather 10 can be connected to a stem 30, or two feathers 10 can be connected to two opposite sides of a stem 30. Therefore, the present embodiment can have different connecting configurations.

In this embodiment, the feather 10 includes a connecting portion 11, which refers to the place where the feather 10 and the stem 30 are connected to each other, that is, the connecting portion 11 is connected to one of the plurality of stems 30. In this embodiment, glue can be applied to the stem 30 first, and then the feather 10 is placed on the glue-coated stem 30, and the feather 10 and the stem 30 are connected by hot press bonding. And the part where the feather 10 is adhered to the stem 30 is the connecting portion 11.

Figure 3:
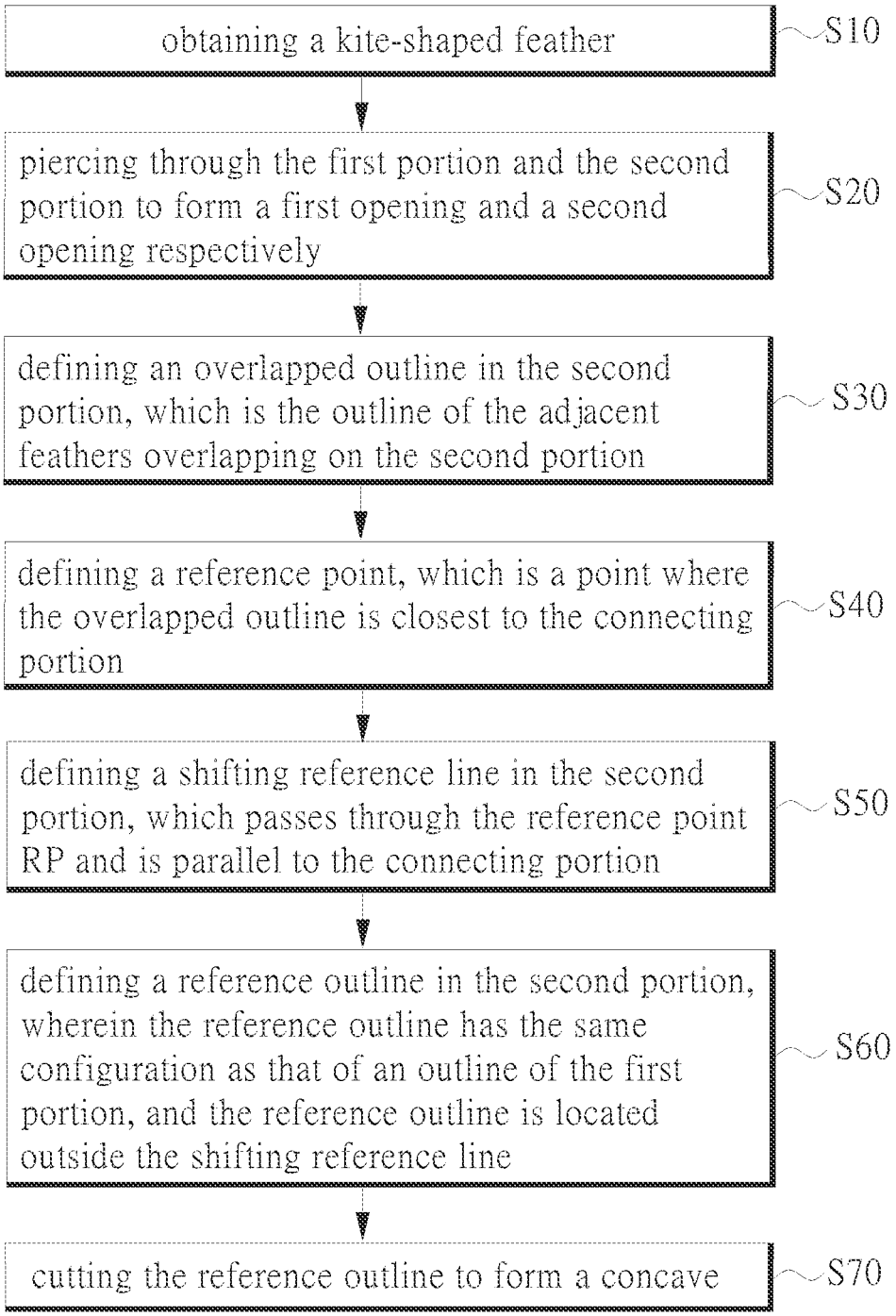
FIG. 3 illustrates a flow chart of a method for preparing a feather according to an embodiment of the present disclosure.
Figure 4:
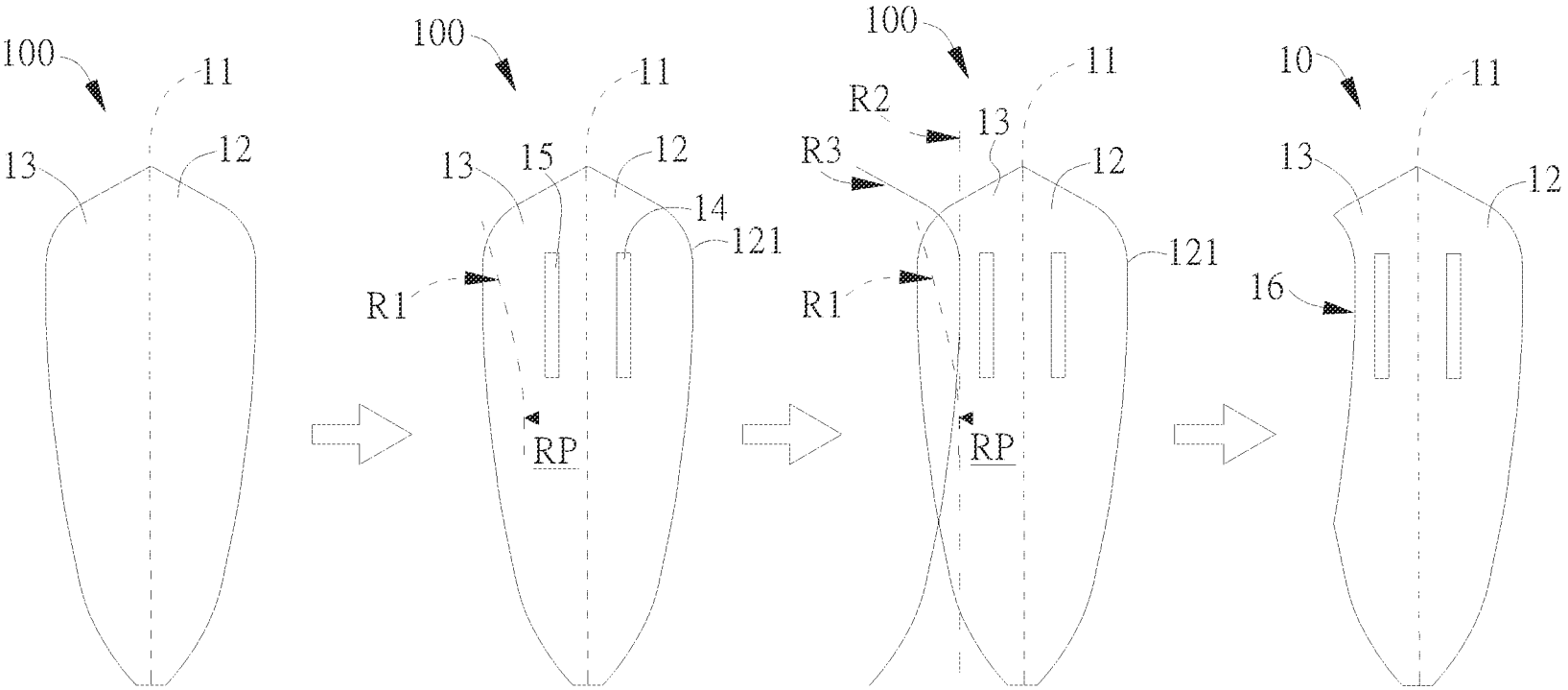
FIG. 4 illustrates a schematic view of the feather shown in FIG. 2 made by the method for preparing the feather shown in FIG. 3.

FIG. 3 illustrates a flow chart of a method for preparing a feather according to an embodiment of the present disclosure, and FIG. 4 illustrates a schematic view of the feather shown in FIG. 2 made by the method for preparing the feather shown in FIG. 3. Please refer to FIG. 1 to FIG. 4, the details of each step of the method for preparing feather 10 are described, and the structural features of the feather 10 of this embodiment are also described.

Step S10: obtaining a kite-shaped feather 100.

The feather 10 in this embodiment is cut from the kite-shaped feather 100 (please refer to FIG. 4). The kite-shaped feather 100 has long and short diagonal lines. The connecting portion 11 and the long diagonal line of the kite-shaped feather 100 overlap each other. In this embodiment, opposite sides of the connecting portion 11 of the feather 10 (kite-shaped feather 100) are defined as the first portion 12 and the second portion 13 respectively. In other words, the feather 10 (the kite-shaped feather 100) of this embodiment includes the connecting portion 11, the first portion 12, and the second portion 13, and the connecting portion 11 is connected to the stem 30, the first portion 12 and the second portion 13 are respectively located on the opposite sides of the connecting portion 11.

In this embodiment, the feather 10 is also an artificial feather, which is used to replace natural feathers. In this embodiment, the feather 10 is made of plastic with a density between 0.9 g/cm$^3$ and 1.48 g/cm$^3$, and the type of plastic can be, for example, but not limited to, low density polyethylene (LDPE), linear low density polyethylene(LLDPE), polyethylene terephthalate (PET), polyethylene (PE), polypropylene (PP), aciylonitrile-butadiene-styrene (ABS), polyamide (PA), and extruded polyethylene (EPE). Preferably, the feather 10 may be a combination of low density polyethylene (LDPE) and linear low density polyethylene (LLDPE).

Step S20: Piercing through the first portion 12 and the second portion 13 to form a first opening 14 and a second opening 15 respectively.

Figure 5:
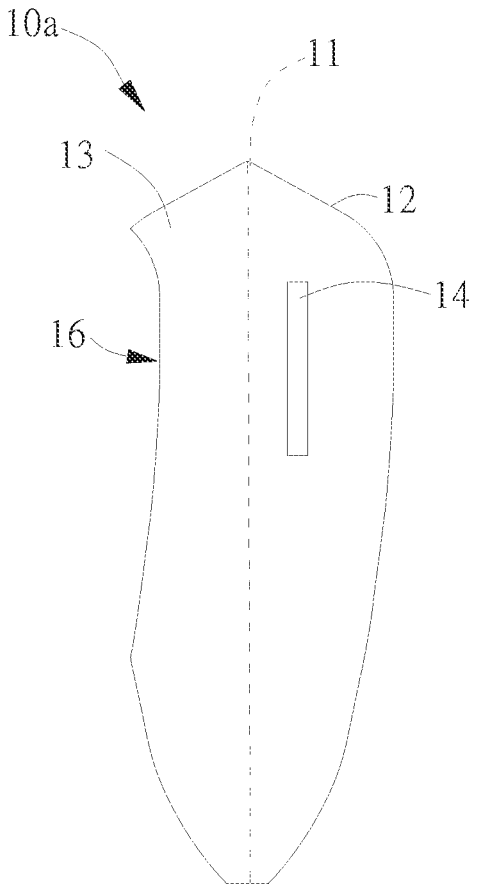
FIG. 5 illustrates a schematic plan view of a feather according to another embodiment of the present disclosure.

Each feather 10 (the kite-shaped feather 100) includes at least one opening. In this embodiment, two openings are taken as an example for illustration. The first opening 14 is disposed in the first portion 12, and the second opening 15 is disposed in the second portion 13. Moreover, the first opening 14 and the second opening 15 can be substantially the same. In other embodiments, only the first opening 14 is disposed in the first portion 12, however, the present disclosure is not limited to these configurations. As shown in FIG. 5, in which a schematic plan view illustrates a feather according to another embodiment of the present disclosure. The feather 10*a* may have only one opening (that is, the first opening 14), and it is located in the first portion 12. Correspondingly, step S20 can also be to form a first opening 14 in the first portion 12.

The first opening 14 and the second opening 15 are elongated structures, preferably rectangular, and the long axes of the first opening 14 and the second opening 15 may be parallel to the connecting portion 11. Specifically, a cutter can be applied on the first portion 12 and the second portion 13 to cut a part of the plastic foam material of the feather 10 (the kite-shaped feather 100). The cutter preferably has a rectangular structure, and the long axis of the cutter is arranged in parallel with the connecting portion 11 and corresponds to the first portion 12 and the second portion 13. Then the feather 10 is cut to form a rectangular cut, thereby forming the first opening 14 and the second opening 15.

Preferably, the first opening 14 and the second opening 15 can be symmetrically arranged in the feather 10 with the connecting portion 11 being the axis of symmetry. Moreover, the first opening 14 and the second opening 15 can have substantially the same configuration. However, it should be noted that the second opening 15 can't be disposed at the position of the concave 16 (explained further below).

Preferably, as shown in FIG. 2, the connecting portion 11 has a first length L1, and the first opening 14 has a second length L2. Specifically, the length of the first opening 14 along the long axis is the second length L2. In this embodiment, the ratio of the second length L2 to the first length L1 is limited to be between 0.22 and 0.31. Since the feather 10 (the portion excluding the first opening 14) is mainly an area consisted of a high density of plastic foaming material, and the first opening 14 is an area where no plastic foaming material is formed, during the flight of the artificial shuttlecock 1, different wind resistances are generated due to the difference in material density between the first opening 14 and other areas of the feather 10.

Step S30: Defining an overlapped outline R1 in the second portion 13, which is the outline 101 of the adjacent feathers (that is, the kite-shaped feather 100*a*) overlapping on the second portion 13.

Figure 6:
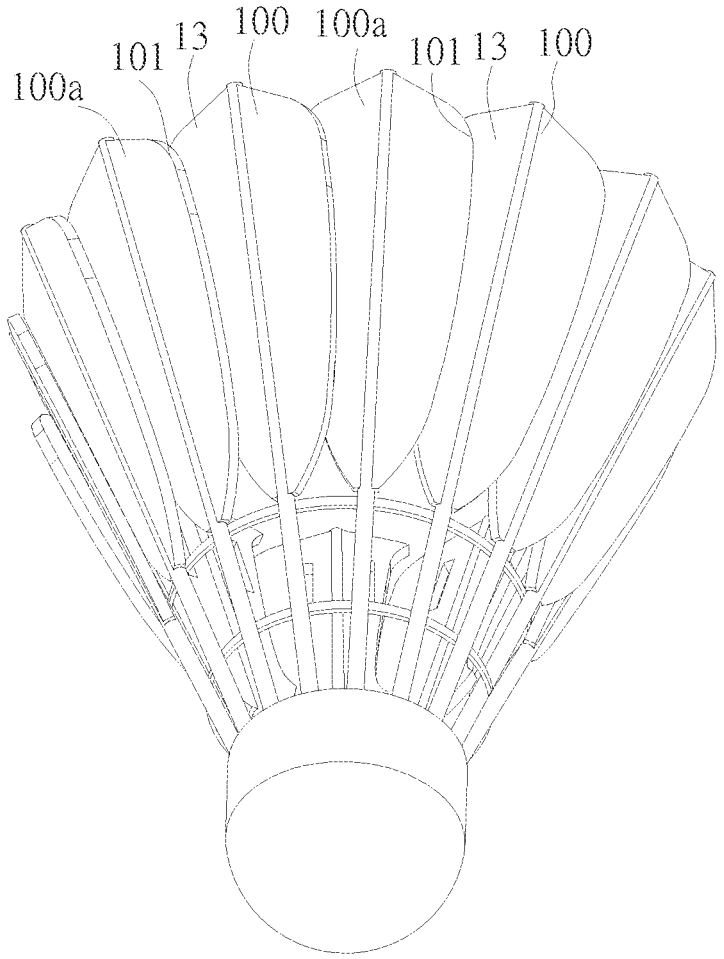
FIG. 6 illustrates a schematic view of an overlapped Outline shown in FIG. 4.

First, the present disclosure defines an overlapped outline R1 in the second portion 13. Please refer to FIG. 6, which illustrates a schematic view of an overlapped outline shown in FIG. 4. It should be noted that the overlapped outline R1 is a virtual reference line, which is used to evaluate an outline 101 of the second portion 13 when the plurality of feathers 100 is inserted in the ball head 20 (as shown in FIG. 6) and the adjacent feathers 100*a* overlaps on the second portion 13. Because the arrangement of the feather 100 on the ball head 20 resembles the arrangement of a natural badminton, the kite-shaped feather 100 partially overlaps the adjacent feather 100*a* near its short axis. In step S30, a computer simulation method or a conventional artificial shuttlecock (as shown in FIG. 6) can be directly used to draw the outline 101 of the adjacent feather 100*a* overlapping the second portion 13, thereby defining the outline 101 as an overlapped outline R1 (virtual reference line as shown in FIG. 4).

Step S40: Defining a reference point, which is a point where the overlapped outline R1 is closest to the connecting portion 111.

Refer to FIG. 3 and FIG. 4 again. Because the overlapped outline R1 is an arc-shaped curve (that is, a part of the kite shape), the point closest to the connecting portion 11 can be found and defined as the reference point RP. In other words, the reference point RP is a virtual reference point (such as the triangular square in FIG. 4), which is the point on the overlapped outline R1 that is closest to the connecting portion 11.

Step S50: Defining a shifting reference line R2 in the second portion 13, which passes through the reference point RP and is parallel to the connecting portion 11.

Next, a parallel line of the connecting portion 11 is drawn at the reference point RP as a shifting reference line R2, so that the reference point RP is parallel to the connecting portion 11. Similarly, the shifting reference line R2 is a virtual reference line, which is the shifting reference of other reference line drawn in the subsequent steps (that is, the reference outline R3).

Step S60: Defining a reference outline R3 in the second portion 13, wherein the reference outline R3 has the same configuration as that of an outline 121 of the first portion 12, and the reference outline R3 is located outside the shifting reference line.

Next, the outline 121 of the first portion 12 is replicated and shifted to the outside of the reference line R2 as the reference outline R3. It should be noted that the outside of the shifting reference line R2 refers to the portion of the shifting reference line R2 farther away from the connecting portion 11. Taking the kite-shaped feather 100 as an example, the outside of the shifting reference line R2 refers to the portion between the shifting reference line R2 and the outer edge of the second portion 13. In this embodiment, the reference outline R3 is formed by shifting the outline 121 of the first portion 12 to be partially aligned with the shifting reference line R2, so that the other part of reference outline R3 is located outside of shifting reference line R2.

In other words, the reference outline R3 is the outline 121 of the first portion 12 horizontally shifted to the second portion 13, so that the reference outline R3 is parallel to the outline 121 of the first portion 12. In other embodiments, the reference outline R3 can also be the outline 121 of the first portion 12 horizontally shifted to the second portion 13 to be further adjusted with respect to position or angle (described further below) according to the requirements of the disclosure, and is not limited to any specific adjustment.

Step S70: Cutting the reference outline R3 to form a concave 16.

Finally, the reference outline R3 is cut to form a concave 16 in the second portion 13, thereby obtaining the feather 10 of this embodiment. In other words, the concave 16 of the feather 10 is located at the outer edge of the second portion 13. In other words, the feather 10 was originally in the shape of a kite (that is, the kite-shaped feather 100) and turned out to have an irregular configuration after the second portion 13 is cut to form the concave 16.

In general, the concave 16 of the feather 10 is formed by the following steps: Defining an overlapped outline R1 in the second portion 13, which is the outline 101 of the adjacent feathers (or the kite-shaped feather 100*a*) overlapping on the second portion 13 (Step S30); defining a reference point, which is a point where the overlapped outline R1 is closest to the connecting portion 11 (Step S40); defining a shifting reference line R2 in the second portion 13, which passes through the reference point RP and is parallel to the connecting portion 11 (Step S50); defining a reference outline R3 in the second portion 13 wherein the reference outline R3 has the same configuration as that of an outline 121 of the first portion 12, and the reference outline R3 is located outside the shifting reference line (Step S60); and cutting the reference outline R3 to form the concave 16 (step S70).

Figure 7A:
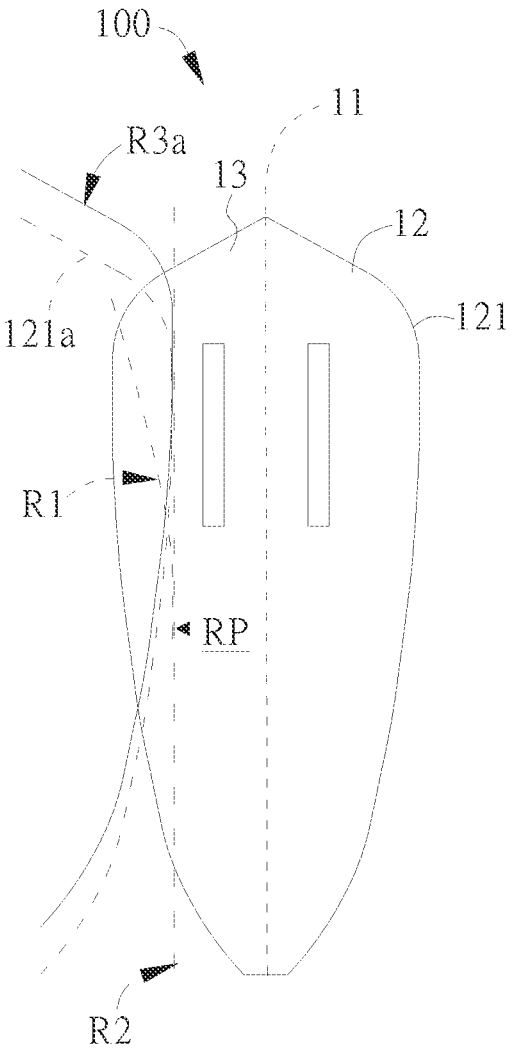
FIGS. 7A and 7B illustrate schematic views of another embodiment of step S60 shown in FIG. 3.
Figure 7B:
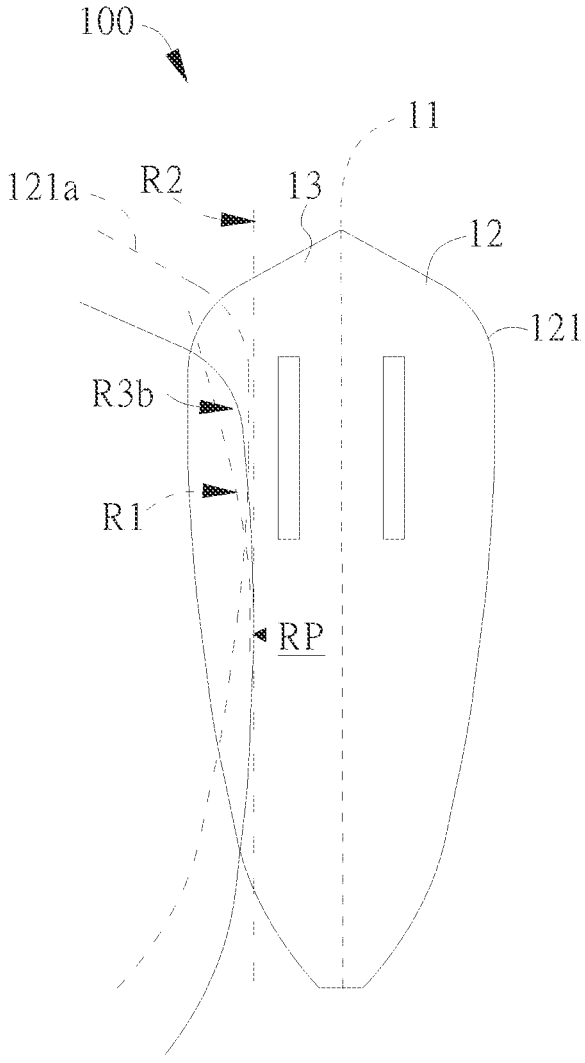

FIGS. 7A and 7B are schematic views of another embodiment of step S60 shown in FIG. 3 please refer to FIG. 3, FIG. 7A, and FIG. 7B. In this embodiment, moving the reference outlines R3*a*, R3*b* to he located outside the shifting reference line R2 in step S60 includes shifting the outline 121 of the first portion 12 to the second portion 13 (the shifted outline 121*a* is represented by a dashed line), moving it upwards to define it as the reference outline R3*a* (as shown in FIG. 7A), or moving it downwards to define it as the reference outline R3*b* (FIG. 7B). In other words, the reference outlines R3*a*, R3*b* of this embodiment is the outline 121 of the first portion 12 being shifted to the second portion 13 (that is, the shifted outline 121*a*), and then moved upwards (as shown in FIG. 7A), or downwards (as shown in FIG. 7B).

Figure 8:
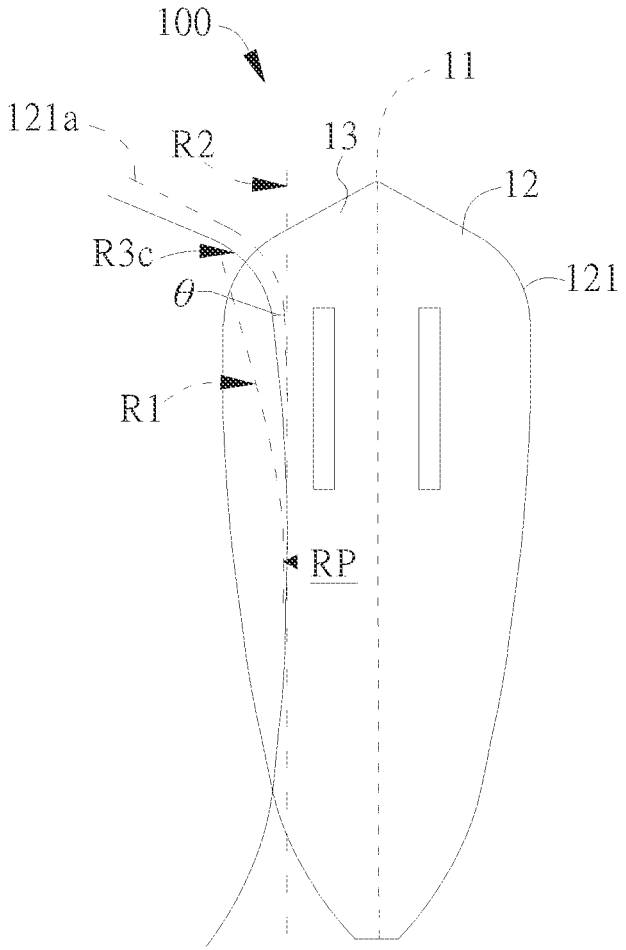
FIG. 8 illustrates a schematic view of another embodiment of step S60 shown n FIG. 3.

FIG. 8 is a schematic view of another embodiment of step S60 shown in FIG. 3, please refer to both FIG. 3 and FIG. 8. In this embodiment, moving the reference outline R3*c* to be located outside the shifting reference line R2 in step S60 includes shifting the outline 121 of the first portion 12 to the second portion 13 (such as the shifted outline 121*a*), rotating a predetermined angle to define it as the reference outline R3*c* (FIG. 8). In other words, the reference outline R3*c* of this embodiment is the outline 121 of the first portion 12 being shifted to the second portion 13 (that is, the shifted outline 121*a*) and then rotated by a predetermined angle. Preferably, the predetermined angle can be between 3 degrees and 10 degrees. Furthermore, it should be noted that the shifted outline 121*a* shown in FIG. 7A, FIG. 7B, and FIG. 8 is the reference outline R3 shown in FIG. 4 (in the aforementioned embodiment).

Furthermore, the artificial shuttlecock 1 of this embodiment is consisted of an irregular feather 10 (that is, a feather 10 having a concave 16), while compared with a kite-shaped feather 100 regarding to hitting impact, the artificial shuttlecock 1 has better flight performance than that of the conventional artificial shuttlecock.

Table 1 is a test report of the hitting impact of the artificial shuttlecock (from A to C) of various structures.

TABLE 1

| Artificial Shuttlecock Number | Structural Features | Flight Control (9-point scale) | Overall Evaluation (9-point scale) |
|---|---|---|---|
| A | (1)kite-shaped feather<br>(2)two openings | 2.7 | 3.0 |
| B | (1) feather of irregular shape<br>(2) an opening | 5.3 | 5.7 |
| C | (1)feather of irregular shape<br>(2) two openings | 6.0 | 6.7 |

It should be noted that number A is the conventional artificial shuttlecock consisted of kite-shaped feathers and has the first opening 14 and the second opening 15 of the aforementioned embodiment; number B is an artificial shuttlecock consisted of irregular feathers (feather 10*a* with a recess 16 in FIG. 5) with one opening (that is, the first opening 14); number C is the artificial shuttlecock 1 of the aforementioned example consisted of irregular feathers (such as feather 10 with concave 16 in FIG. 2) with two openings (that is, first opening 14 and second opening 15).

Furthermore, the "drop shots in front of the net (9-point scale)" field is the evaluation of the flight performance of the artificial shuttlecocks A to C when the user uses the drop shot skill to play the shuttlecock, with a score of 0 to 9. When the user hits the artificial shuttlecocks A to C, these artificial shuttlecocks are evaluated based on the number of turns and the number of rotations of the artificial shuttlecocks, or the elasticity and softness felt by the user when hitting. The higher the score, the closer the flight performance is to a natural shuttlecock. In addition, the "Overall Evaluation (9-point scale)" field is fir the overall evaluation of the flight conditions and performance of the artificial shuttlecocks A to C when they are hit. Similarly, the better the flight performance, the higher the score will be.

From the results of the hitting impact test shown in the above table, it can be seen that the artificial shuttlecocks B and C consisted of irregular feathers are performing better than the artificial shuttlecock A consisted of kite-shaped feathers regarding to flight control (drop shots in front of the net) or overall evaluation.

As described above, according to the artificial shuttlecock, the feather, and the method for preparing the feather of the present disclosure, the opposite sides of the connecting portion of the feather are formed into a first portion and a second portion respectively. By forming an (first) opening in the first portion and a concave formed in the outer edge of the second portion, the feathers are formed into an irregular shape. Furthermore, the concave is formed by first defining an overlapped outline and then cutting along a reference outline. After performing a hitting impact test on the artificial shuttlecock of the present disclosure, it can be seen that the artificial feather consisted of irregular feathers (with concaves) has better aerodynamic stability than that of the conventional artificial shuttlecock, that is, it has better flight performance.

It should be noted that many of the above-mentioned embodiments are given as examples for description, and the scope of the present invention should be limited to the scope of the following claims and not limited by the above embodiments.

What is claimed is:

1. A feather for an artificial shuttlecock, wherein the artificial shuttlecock comprises a ball head, a plurality of stems and a plurality of feathers, each one of the plurality of stems has one end inserted into the ball head and another end connected to one of the plurality of feathers respectively, each one of the plurality of feathers comprising:

a connecting portion connecting to one of the plurality of stems;

a first portion and a second portion disposed on the opposite sides of the connecting portion respectively;

a first opening disposed in the first portion, and a concave located at an outer edge of the second portion and formed by the following steps of:

defining an overlapped outline, which is the outline of the adjacent feathers overlapping on the second portion;

defining a reference point, which is a point where the overlapped outline is closest to the connecting portion;

defining a shifting reference line, which passes through the reference point and is parallel to the connecting portion;

defining a reference outline in the second portion, wherein the reference outline has the same configuration as that of an outline of the first portion, and the reference outline is located outside the shifting reference line; and cutting the reference outline to form the concave.

2. The feather as claimed in claim 1, wherein the reference outline is the outline of the first portion being shifted to the second portion, so that the reference outline is parallel to the outline of the first portion.

3. The feather as claimed in claim 1, wherein the reference outline is the outline of the first portion shifted upwards or downwards after being shifted to the second portion.

4. The feather as claimed in claim 1, wherein the reference outline is the outline of the first portion being rotated by a predetermined angle after being shifted to the second portion.

5. The feather as claimed in claim 4, wherein the predetermined angle is between 3 degrees and 10 degrees.

6. The feather as claimed in claim 1, wherein a long axis of the first opening is parallel to the connecting portion, the connecting portion has a first length, the first opening has a second length, and the ratio of the second length to the first length is between 0.22 and 0.31.

7. The feather as claimed in claim 1 further comprising:

a second opening being disposed in the second portion and not in contact with the concave.

8. The feather as claimed in claim 1, wherein the feather is originally in a kite-shaped configuration, and after the second portion is cut to form the concave, the feather turns into an irregular configuration.

9. A method for preparing a feather for an artificial shuttlecock, wherein the artificial shuttlecock comprises a ball head, a plurality of stems and a plurality of feathers, each one of the plurality of stems has one end inserted into the ball head and another end connected with one of the plurality of feathers respectively, the method for preparing the feathers comprising the following steps of:

obtaining the feather having a kite shape, wherein the feather comprises a connecting portion, a first portion, and a second portion, the connecting portion is connected to one of the plurality of stems, the first portion and the second portion are disposed on the opposite sides of the connecting portion respectively;

piercing through the first portion to form a first opening;

defining an overlapped outline in the second portion, which is the outline of the adjacent feathers overlapping on the second portion;

defining a reference point, which is a point where the overlapped outline is closest to the connecting portion;

defining a shifting reference line in the second portion, which passes through the reference point and is parallel to the connecting portion;

defining a reference outline in the second portion, wherein the reference outline has the same configuration as that of an outline of the first portion, and the reference outline is located outside the shifting reference line; and cutting the reference outline to form a concave.

10. The method for preparing a feather as claimed in claim 9, wherein the reference outline is the outline of the first portion being shifted to the second portion, so that the reference outline is parallel to the outline of the first portion.

11. The method for preparing a feather as claimed in claim 9, wherein the reference outline is the outline of the first portion shifted upwards or downwards after being shifted to the second portion.

12. The method for preparing a feather as claimed in claim 9, wherein the reference outline is the outline of the first portion being rotated by a predetermined angle after being shifted to the second portion.

13. The method for preparing a feather as claimed in claim 12, wherein the predetermined angle is between 3 degrees and 10 degrees.

14. The method for preparing a feather as claimed in claim 9, wherein a long axis of the first opening is parallel to the connecting portion, the connecting portion has a first length, the first opening has a second length, and the ratio of the second length to the first length is between 0.22 and 0.31.

15. The method for preparing a feather as claimed in claim 9, wherein the feather is originally in a kite-shaped configuration, and after the second portion is cut to form the concave, the feather turns into an irregular configuration.

16. An artificial shuttlecock comprising:

a ball head;

a plurality of stems, each one of the plurality of stems having one end inserted into the ball head; and a plurality of feathers, each one of the plurality of feathers being connected to another end of each one of the plurality of stems respectively, each one of the plurality of feathers comprising:

a connecting portion being connected to one of the plurality of stems;

a first portion and a second portion disposed on the opposite sides of the connecting portion respectively;

a first opening disposed in the first portion, and a concave located at an outer edge of the second portion and formed by the following steps of:

defining an overlapped outline, which is the outline of the adjacent feathers overlapping on the second portion;

defining a reference point, which is a point where the overlapped outline is closest to the connecting portion;

defining a shifting reference line, which passes through the reference point and is parallel to the connecting portion;

defining a reference outline in the second portion, wherein the reference outline has the same configuration as that of an outline of the first portion, and the reference outline is located outside the shifting reference line; and cutting the reference outline to form the concave.

* * * * *